United States Patent [19]

Koller

[11] 4,453,363

[45] Jun. 12, 1984

[54] STRUCTURAL ELEMENT BAR FOR BUILDINGS, OR THE LIKE

[76] Inventor: Ernst Koller, Paradiesstrasse 64, CH-4102 Binningen, Schweiz, Switzerland

[21] Appl. No.: 348,332

[22] Filed: Feb. 12, 1982

[30] Foreign Application Priority Data

Mar. 31, 1981 [DE] Fed. Rep. of Germany ..... 3112746

[51] Int. Cl.[3] ..... E04B 2/60

[52] U.S. Cl. ..... 52/481; 52/372; 52/729; 52/731

[58] Field of Search ..... 52/481, 461, 486, 489, 52/466, 376, 710, 372, 533, 465, 463, 729–732

[56] References Cited

U.S. PATENT DOCUMENTS

| | | | |
|---|---|---|---|
| 2,904,851 | 9/1959 | Griffin et al. | 52/486 |
| 3,004,636 | 10/1961 | Shane | 52/710 |
| 3,043,408 | 7/1962 | Attwood . | |
| 3,548,557 | 12/1970 | Downing | 52/461 |
| 4,073,113 | 2/1978 | Oudot et al. | 52/710 |
| 4,159,604 | 7/1979 | Burrell | 52/376 |

FOREIGN PATENT DOCUMENTS

| | | | |
|---|---|---|---|
| 2308121 | 8/1973 | Fed. Rep. of Germany . | |
| 2320592 | 10/1974 | Fed. Rep. of Germany | 52/481 |
| 2901337 | 3/1980 | Fed. Rep. of Germany . | |

*Primary Examiner*—James L. Ridgill, Jr.

*Attorney, Agent, or Firm*—Ostrolenk, Faber, Gerb & Soffen

[57] ABSTRACT

The disclosure concerns a structural element for use in buildings or the like, which structural element is generally I-beam shaped. The structural element includes a web and two flanges at the opposite edges of the web and extending across the edges of the web and along the length of the web. The flanges are shaped so as to have an outwardly facing groove. In addition, a groove is defined between the two flanges at each side of the web. The flange is so shaped that the outward end of each groove is narrower in width than the section of the groove nearer to the web. The side extensions of the flanges are oriented so that opposite flanges are parallel. The two flanges are of different widths.

11 Claims, 3 Drawing Figures

STRUCTURAL ELEMENT BAR FOR BUILDINGS, OR THE LIKE

BACKGROUND AND SUMMARY OF THE INVENTION

The present invention relates to a structural element or beam, in the shape of a profiled bar, such as an I-beam, for use in constructing various shelters, buildings, or the like, which beam is adapted to permit attachment to itself of plates, disks and other construction parts.

The structural element according to the invention comprises a profiled bar of generally I-shaped cross-section. The web of the bar is capped at both edges by a respective flange that extends across the bar. Each flange is shaped to define outwardly facing grooves which can receive other elements.

Such structural elements are known from German Application OS 29 01 337.

The invention provides a structural element that can be used for a large number of purposes without changing its shape. Plate-shaped construction parts can be applied to the structural element from one side, preferably the outside of the building, against the structural element and they can be firmly attached to the structural element from the other side, preferably the inside of the building, without drill holes having to be formed in the structural element. Furthermore, the structural element is adapted to conduct rain water and condensation away. It is also possible to apply insulation in a simple manner in order to avoid the formation of cold-bridges.

This object is achieved by the features in accordance with the invention. The structural element according to the invention has its flanges of different respective widths, with one flange being wider from flange edge to flange edge than the other flange. Additionally, the bottom sides of each of the flanges, which face toward the opposite flange, have ribs defined at their outer width ends which reduce the width of the groove between the flanges at that side of the web that is toward the outside of the groove and widen the groove at the web.

The flanges have side extensions which extend outwardly, away from the opposite flange. The side extensions are obliquely inclined and in the preferred embodiment, the diametrically opposite flange extensions on the two flanges are parallel, which facilitates assembly of buildings using standardized parts.

In some embodiments, the web of the beam is only a single layer. In other embodiments, the web is two layers thick. In one of those two layer embodiments, the two layers are spaced apart, which strengthens the beam. In another embodiment, the two layers are adjacent.

The structural element is symmetric through its middle, with both halves being mirror images.

For assembly of the structural element with other building elements, a clamping jaw may be clamped to the flange of a structural element and for supporting the legs of the flange and the extensions of the flange, a clamping piece may be positioned within the groove and the clamping piece then clamps the flange extensions around that groove.

Other objects and features of the invention will become apparent from the following description of preferred embodiments of the invention considered in conjunction with the accompanying drawings.

BRIEF DESCRIPTION OF THE DRAWINGS

Several embodiments of the invention are described with reference to the drawings in which.

DESCRIPTION OF THE PREFERRED EMBODIMENTS

Figure 1:
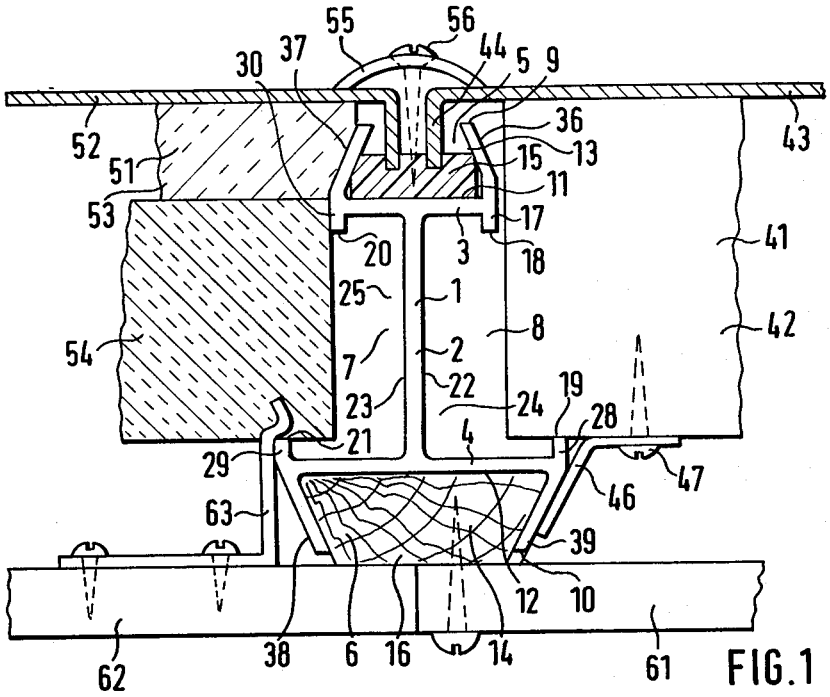
FIG. 1 is an end view of one embodiment of a structural element in accordance with the invention which, together with other identical structural elements, may form the load-bearing structural frame of a building.

In FIG. 1, the structural element 1 is a profiled bar or I-beam, including a web, a narrower width flange at one longitudinally extending edge of the web 2 and a wider width flange 4 at the other longitudinal edge of the web. Each flange extends across the respective edge of the web and along its length. The flange is symmetric around the web, and both halves of the web at the flange are mirror images.

At the outer (top and bottom in FIG. 1) side of each of the flanges 3 and 4, respectively, facing away from the other flange, there is a longitudinal groove 5 and 6, respectively. In the space between the flanges 3 and 4, there are longitudinal grooves 7 and 8, respectively, at both sides of the web 2. The longitudinal grooves 5 and 6 of the flanges 3 and 4 have respective inner sections 13 and 14 of dovetail cross-section, which broaden from the outer end at a narrow space 9 and 10, respectively at the ends of the respective flange legs, towards their wider bottoms 11 and 12 respectively at the web.

The upper longitudinal groove 5 of the narrower flange 3 serves as water gutter. Either rain water or water of condensation may be collected. Heat-insulating material 15 and 16 in the sections 13 and 14, respectively can be contained in order to avoid a cold-bridge from one to the other end of the construction element. Wood, plastic, rubber, etc. are suitable as the insulating material.

The longitudinal grooves 7 and 8 on both sides of the web 2 have inner sections 24 and 25 respectively, which are substantially rectangular in shape from between their inturned opposite flanges 18, 19 and 20, 21, respectively, toward their bottoms 22 and 23, respectively. The flanges 18, 19 and 20, 21 respectively are formed by ribs 27, 28, 29 and 30 which extend substantially at right angles from the ends of the flange legs that define the side walls of the longitudinal grooves 7 and 8, toward the center of the groove.

The outer side extensions 36, 37, 38 and 39 of the flanges 3 and 4 are trapezoidally obliquely inclined toward each other, so that the flanges 3 and 4 have a tapering cross-sectional shape toward the outside and the flanges each have a generally trapezoidal cross-section. The outer side extensions 36 and 37 of the narrower width flange 3 extend substantially parallel to the diametrically opposite outer side extensions 38 and 39 of the wider width flange 4. This permits additional plates to be attached to the structural element in a simple manner and without drilling.

The entire unit shown in FIG. 1 can form a portion of a wall or of a ceiling. In the following, it will be assumed that a ceiling construction is concerned. The structural element 1 serves as a support element for a ceiling plate 41, which is applied from above onto the element. The plate 41 includes an inner plate part 42, which lies on the rib 28 of the structural element 1. An outer part 43 of the ceiling plate 41 extends to an angular extension 44 and into the upper longitudinal groove 5. An angle piece 46, which is accessible from the inside and not from the outside of the building, is screwed to the ceiling plate 41 with a screw 47. The angle piece 46 has one arm that rests against the oblique side extension 39 of the flange 4, so that the flange 4 is clamped at this place snugly between the angle piece 46 and the ceiling plate 41.

When a building is erected with the structural element 1, it is possible to first form a frame with the structural elements 1, to next apply the plates 41 from the outside and to thereafter attach these plates from the inside of the building. In this way, the building can be erected rapidly, and simply, which is of importance, for instance, for makeshift shelters. Furthermore, the plates 41 cannot be removed in an unauthorized manner from the outside.

The ceiling plate 51 at the left in FIG. 1 consists of a cover layer 52 of metal and two inner insulating layers 53 and 54. Like the cover plate, the outer part 43, the cover layer 52 extends to an angular extension and into the groove 5.

The space between the two plates 41 and 51 can be covered by a clamping strip which is clamped between the parts 43 and 52, and an adhesive strip or a cover strip 55 which is screwed by screws 56 firmly onto the insulating material 15. Inner ceiling plates 61 and 62 can be fastened by wood screws to the insulating material 14, which is formed for instance of wood. This material 14 is in the longitudinal groove. Alternatively, these inner plates can be suspended by spring clips on the edges, for instance at the rib 29, of the longitudinal grooves.

Figure 2:
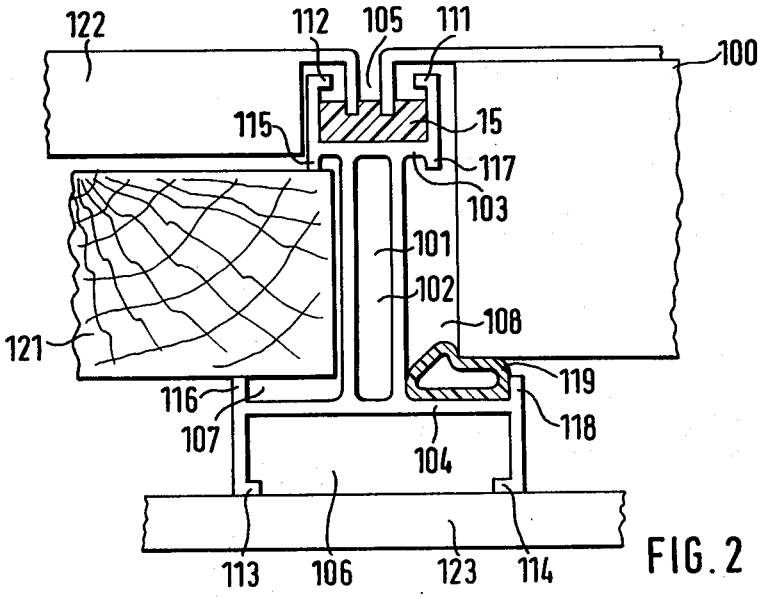
FIG. 2 is an end view of another embodiment of structural element in accordance with the invention, which serves both as a load-bearing structural part and also as a frame and a stop for a door or window sash.

FIG. 2 shows a structural element 101 that may serve, tor instance, as a support and simultaneously as a frame for a door or window sash 100. The web 102 of the element 101 is double-walled with a hollow between the two longitudinally extending parallel walls. In this way, great strength is obtained. Each of the flanges 103 and 104, including its respective outer side extensions, has a substantially rectangular cross-section. The longitudinal grooves 105, 106 on the outsides of the flanges and the longitudinal grooves 107, 108 on both sides of the web 101 and between the flanges also have substantially rectangular cross-sectional shapes. The widened inner groove sections on the outsides of the flanges are defined at their outsides by inturned ribs 111, 112, 113, and 114 that extend from the side walls of the longitudinal grooves substantially at right angles to the middle of the groove. There are also inwardly directed ribs 115, 116, 117 and 118 that extend toward each other and in from the grooves 105, 106 past the interior sides of the flanges.

The door or window sash 100 can rest directly on the rib 118. However, in order to insulate the building from heat and noise, it is advisable for a packing 119 to be inserted between the rib 118 and the web 102. The door or window sash 100 rests on this packing, a short distance in front of the rib 118. Plates or bars 121 can be inserted between a plurality of structural elements 101 arranged side by side. In this way, plates 122 serving as an outer wall can be supported by the bars 121 upon bending of the plates. It is thus possible to make the plates 122 relatively thin. The longitudinal groove 106 of the wider flange 104 is located inside of the building. This groove can serve as the installation space and can be covered by a plate 123 serving as the inner wall.

Figure 3:
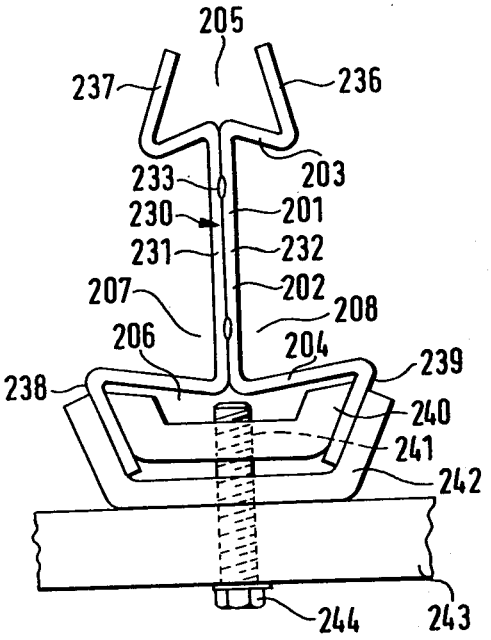
FIG. 3 is an end view of yet another embodiment of the invention having attachment means for construction parts.

The structural element 201 shown in FIG. 3 has a web 202 a narrower flange 203 and a wider flange 204. These flanges are differently shaped than those of the other embodiments. On both the outsides of the flanges and between the flanges at both sides of the web, the longitudinal grooves 205, 206, 207 and 208 are defined, which respectively widen in dovetail shape from the outsides toward the insides of the grooves. The flanges 203 and 204 are tapered toward the outsides of the grooves because the side extensions 236, 237, 238 and 239 of the flanges extend obliquely to each other. The side extensions of each flange extend substantially parallel to the substantially diametrically opposite side extensions of the other flange.

The structural element 201 is formed of two symmetric halves, which meet at a juncture plane 230 that extends in the longitudinal direction over the web 202. The web 202 thereby has two wall layers 231 and 232. The wall layers can be firmly connected to each other by the welds 233 or in some other manner.

A clamping piece 240 with a threaded hole 241 is displaceably inserted within the longitudinal groove 206. The piece 240 is profied to be clamped between the flange legs defining the groove 206. A clamping jaw piece 242 extends over the longitudinal groove 206 and rests on the outsides of the side extensions 238 and 239 of the flange 204. The tightened jaw piece clamps down on the clamping piece 240. The clamping device 240, 242 clamps the arms of the flange 204 firmly within the clamping device, without the structural element being deformed. In this way, parts can be fastened to the structural element 201 without that element being weakened by drill holes or other measures. A stable connection is created with the structural element 201 and a foundation or building part 243. The part 243 is fastened by a screw 244 to the clamping piece 240. The clamping jaw piece 242 may, however, itself be a building part or a part which can be anchored in the ground. In that case, the part 243 can be dispensed with.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A structural element for buildings, or the like, the element being a profiled bar of generally I-shaped cross-section, comprised of a web and two flanges at the opposite edges of the web, and the flanges extending both across and longitudinally along the web; the entire first one of the flanges being relatively narrower in its distance across the web to widthwise ends, and the entire second one of the flanges being relatively wider in that distance across the web to widthwise ends;

each flange having an outside facing away from the other flange, each flange terminating in side extensions at its widthwise ends spaced from the web and the side extensions extending toward the outside of the respective flange away from the other flange and each flange and its side extensions being shaped to define a first groove on its outside; a respective second groove being defined at each side of the web, between the two flanges;

the flanges and their side extensions being shaped so that all of the first and second grooves have a width dimension and so that the width dimension of all of the first and second grooves is narrower away from the connection of the flange with the web and is wider at the bottom of the groove where the flange is joined to the web; the second grooves being narrowed through the insides of both of the flanges, facing toward the other flange, being shaped to extend toward the other flange.

2. The structural element of claim 1, further comprising heat insulation in at least one of the first grooves of one of the flanges.

3. The structural element of claim 1, wherein each side extension on one flange is oriented with respect to the web to be substantially parallel to the diametrically opposite side extension on the other flange.

4. The structural element of claim 3, wherein the side extensions are inclined obliquely with respect to the web, and the two side extensions of each flange are inclined toward each other away from the web, giving the flange a generally trapezoidal cross-section.

5. The structural element of claim 1, wherein the narrowing of the second grooves between the flanges comprises ribs being located at the widthwise ends of the flanges, each beneath a respective side extension, and the ribs of each flange extend toward the opposite other flange.

6. The structural element of claim 5, wherein the bottom sides of the flanges, which extend across and are joined to the web, are perpendicular to the web; the ribs are substantially perpendicular to the bottom sides of the flanges.

7. The structural element of either of claims 1 or 5, wherein the web is comprised of two layers, and both layers extend longitudinally of the structural element, with each second groove being at that side of a respective web layer that is facing away from the other web layer.

8. The structural element of claim 7, wherein each web layer has secured to it a respective half of the first and second flanges at the same respective side of that element as the respective web layer, and the structural element is comprised of two halves which are mirror images and the two halves having a juncture plane which lies between the two web layers.

9. The structural element of either of claims 1 or 5, further comprising a clamping piece inserted in one of the first grooves and being shaped for the flange parts defining that groove to be in clamping contact with the clamping piece;

a clamping jaw fastened to those flange parts which are holding the clamping piece and the jaw being clamped to those flange parts.

10. The structural element of claim 9, further comprising means on the clamping jaw for having other construction parts secured thereto.

11. In combination, a structural element according to any of claims 1, 5 or 6, and plate-shaped construction parts for forming a structure and the parts being received in at least some of the grooves.

* * * * *